US006077099A

United States Patent [19]

Pei et al.

[11] Patent Number: 6,077,099

[45] Date of Patent: Jun. 20, 2000

[54] ZERO INSERTION FORCE CONNECTOR

[75] Inventors: Wen-Chun Pei, Taipei; Yao-Chi Huang, Yung-Ho, both of Taiwan

[73] Assignee: Hon Hai Precision Ind. Co., Ltd., Taipei Hsien, Taiwan

[21] Appl. No.: 09/344,303

[22] Filed: Jun. 24, 1999

[30] Foreign Application Priority Data

Dec. 22, 1998 [TW] Taiwan ..... 87221344

[51] Int. Cl.[7] ..... H01R 4/50

[52] U.S. Cl. ..... 439/342; 439/263

[58] Field of Search ..... 439/342, 330, 439/331, 259–266

[56] References Cited

U.S. PATENT DOCUMENTS

| | | | |
|---|---|---|---|
| 5,123,855 | 6/1992 | Petersen | 434/263 |
| 5,147,213 | 9/1992 | Funk et al. | 439/263 |
| 5,256,080 | 10/1993 | Bright | 439/342 |
| 5,482,471 | 1/1996 | Mori et al. | 439/331 |
| 5,489,218 | 2/1996 | McHugh | 439/342 |
| 5,855,489 | 1/1999 | Walker | 439/342 |

*Primary Examiner*—Hien Vu
*Attorney, Agent, or Firm*—Wei Te Chung

[57] ABSTRACT

An electrical connector includes a base having a top face in which contacts are retained. A cover defining a plurality of through holes for receiving pins of a central processing unit is mounted to the base thereby defining an interior space therebetween for accommodating a slide plate. The slide plate has a conductive member corresponding to each of the contacts and is movable to electrically engage each contact with the corresponding pin of the central processing unit. Two elongate recesses are defined in the top face of the cover. Each elongate recess has two end walls forming two opposite inclined faces. Two elongate projections are formed on a bottom face of the cover and are received in the recesses of the base. Each projection has two inclined end faces matingly and guidingly engaging with the end walls of the corresponding recess thereby properly positioning the cover with respect to the base and preventing the cover from sliding with respect to the base during movement of the slide plate.

5 Claims, 3 Drawing Sheets

ZERO INSERTION FORCE CONNECTOR

BACKGROUND OF THE INVENTION

1. Field of the Invention

The present invention generally relates to a zero insertion force (ZIF) electrical connector, and in particular to a ZIF connector with a cover lead-in device.

2. The Prior Art

A zero insertion force (ZIF) connector comprises a casing constituting a base and a cover fixed together and defining an interior space therebetween for receiving a slide plate which is movable between an engaged position and a released position. The cover defines a plurality of holes for receiving pins of an electronic device, such as a central processing unit positioned thereon. The base retains a plurality of contacts therein. When the slide plate is moved to the engaged position, electrical connection is formed between the pins of the electronic device and the contacts of the connector. When the slide plate is moved to the released position, the pins are electrically disconnected from the contacts.

However, the structure of the conventional ZIF connector prohibits the cover from being efficiently and readily fixed to the base due to the difficulty of precisely positioning the cover with respect to the base. Furthermore, the slide plate imposes a frictional force on the cover during movement thereof. The conventional ZIF connector does not provide means for preventing the cover from separating from the base due to such a frictional force.

Thus, it is desired to have a ZIF connector that provides an efficient and secure engagement between a cover and a base thereby eliminating the problems discussed above.

SUMMARY OF THE INVENTION

Accordingly, an object of the present invention is to provide a ZIF connector comprising lead-in means for efficiently mounting a cover to a base.

Another object of the present invention is to provide a ZIF connector comprising a cover securely fixed to a base.

To achieve the above objects, an electrical connector in accordance with the present invention comprises a base having a top face in which contacts are retained. A cover defining a plurality of through holes. for receiving pins of a central processing unit is mounted to the base thereby defining an interior space therebetween for accommodating a slide plate. The slide plate has a conductive member corresponding to each of the contacts and is movable to electrically engage each contact with the corresponding pin of the central processing unit. Two elongate recesses are defined in the top face of the cover. Each elongate recess has two end walls forming two opposite inclined faces. Two elongate projections are formed on a bottom face of the cover and are received in the recesses of the base. Each projection has two inclined end faces matingly and guidingly engaging with the end walls of the corresponding recess thereby properly positioning the cover with respect to the base and preventing the cover from sliding with respect to the base during movement of the slide plate.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
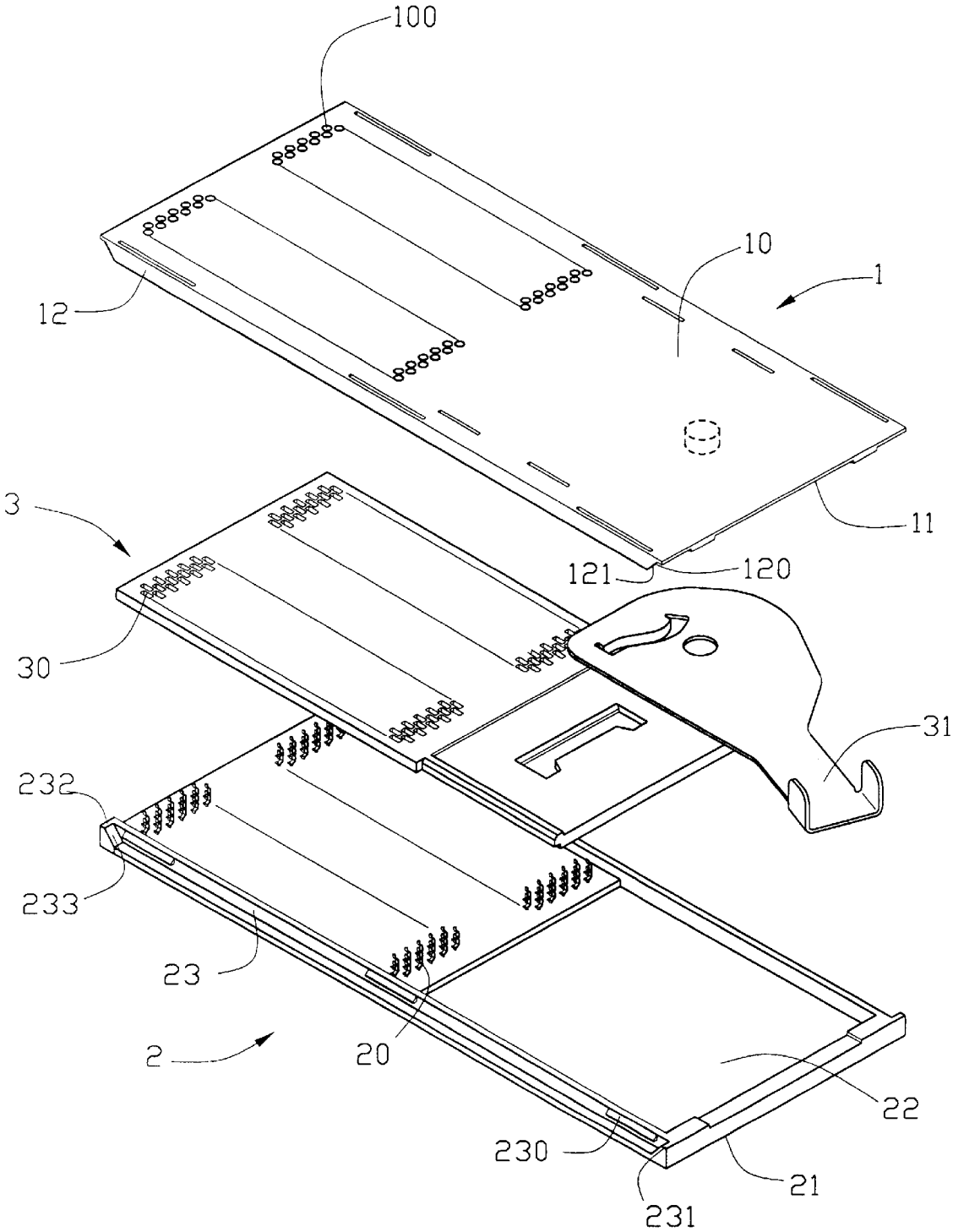
FIG. 1 is an exploded view of an electrical connector in accordance with the present invention.
Figure 2:
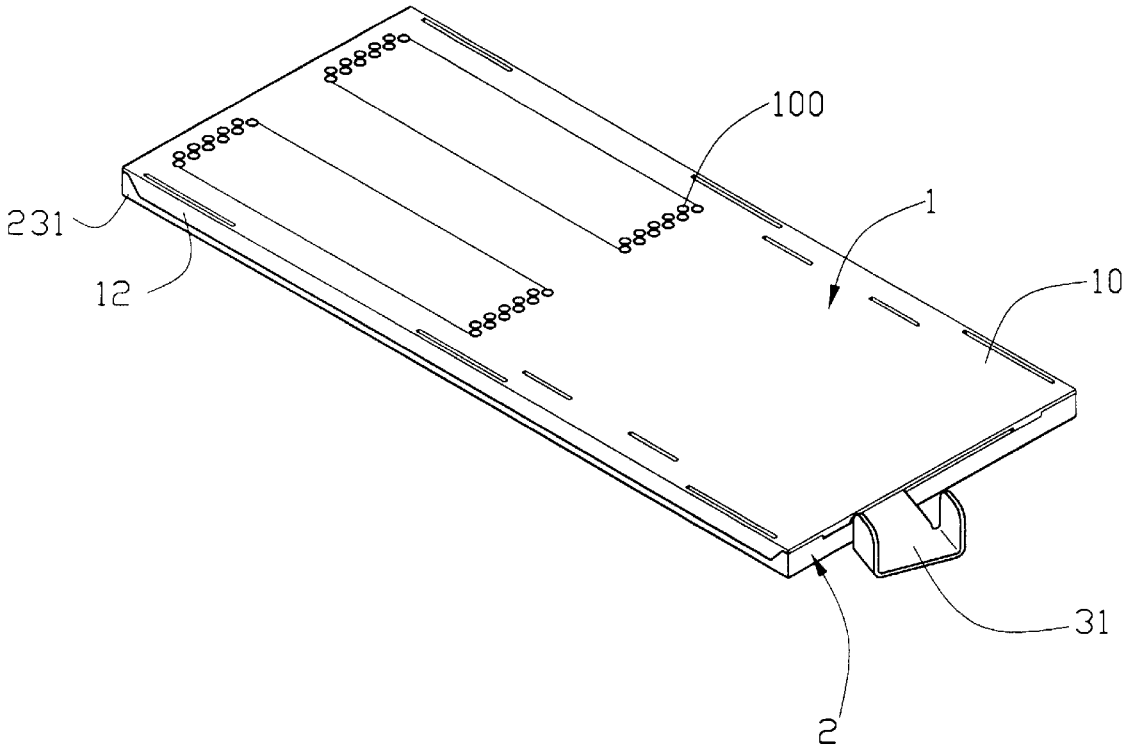
FIG. 2 is an assembled view of FIG. 1.
Figure 3:
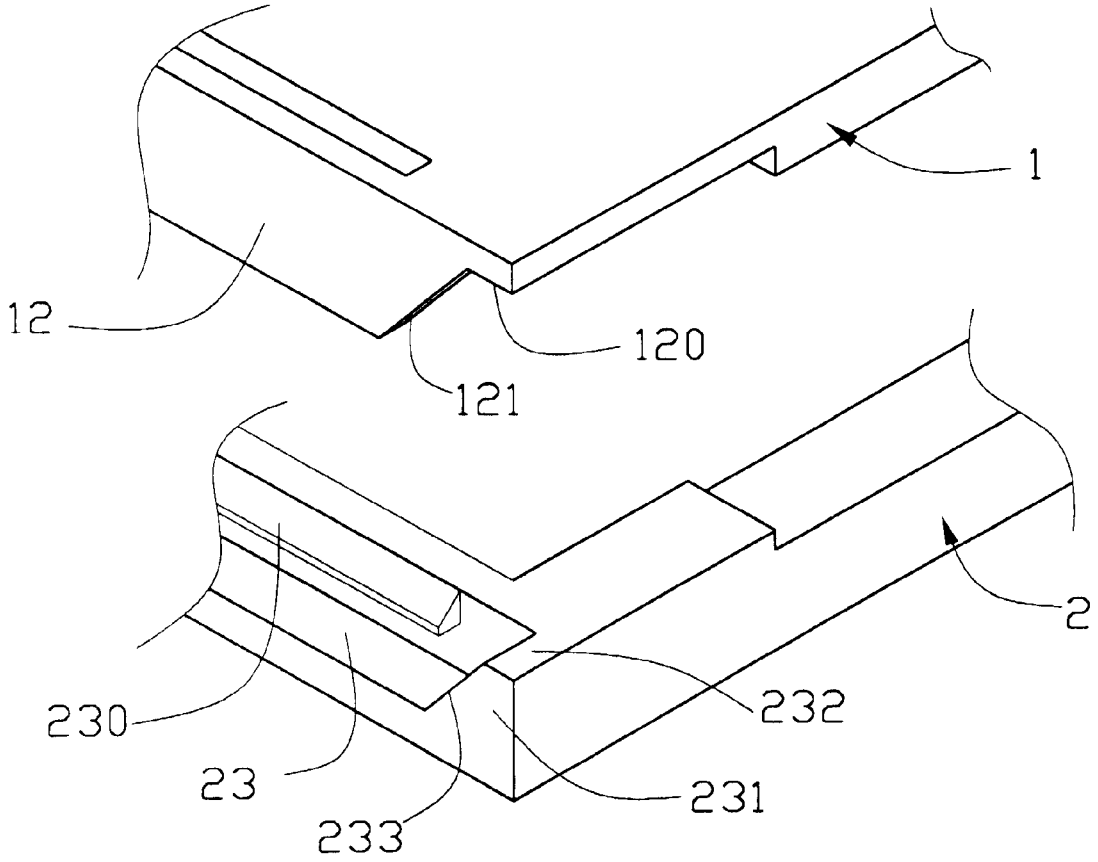
FIG. 3 is an enlarged view of a portion of the electrical connector with a cover thereof separated from a base.

Referring to the drawings and in particular to FIGS. 1 and 2, an electrical connector in accordance with the present invention comprises a cover 1 and a base 2. The cover 1 is fixed to the base 2 to define an interior space therebetween for receiving a slide plate 3. The slide plate 3 is movable between an engaged position and a released position. The cover 1 has a top face 10 on which an electronic device (not shown), such as a central processing unit module, is positioned and an opposite bottom face 11 confronting the base 2. A plurality of holes 100 is defined in the cover 1 between the top and bottom faces 10, 11 for receiving pins of the electronic device. Elongate projections 12 are formed on the bottom face 11 along two opposite edges of the cover 1. As shown in FIG. 3, a cutout is defined at each of two opposite ends of each flange 12 and forms a first support face 120 substantially coincident with the bottom face 11 of the cover 1 and a first mating face 121. The first mating faces 121 are inclined and converge toward each other.

The base 2 has a bottom face 21 positioned on and mounted to a circuit board (not shown) and an opposite top face 22 confronting the cover 1. Two recesses 23 are defined in the top face 22 substantially extending along edges of the base 2. The recesses 23 correspond to and receive the projections 12 of the cover 1. Each recess 23 forms barbs 230 therein for snappingly fitting into corresponding slots (not shown) defined in the projection 12 thereby securing the cover 1 to the base 2.

As shown in FIG. 3, each recess 23 of the base 2 forms a pair of end walls 231 at opposite ends thereof. Each end wall 231 forms a second support face 232 on a top side thereof and a second mating face 233 on a lateral side thereof. The second mating face 233 is inclined corresponding to the first mating face 121 of the cover 1.

Figure 4:
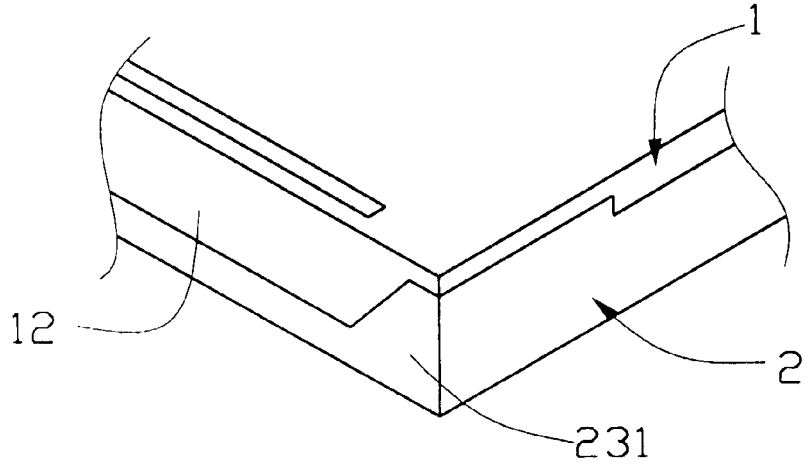
FIG. 4 is similar to FIG. 3 with the cover mounted to the base.

As shown in FIG. 4, when the cover 1 is mounted to the base 2, the second support face 232 supports the first support face 120 and the second mating face 233 matingly engages with the first mating face 121. The inclination of the mating faces 121, 233 serves as lead-in means for guiding the cover 1 to a predetermined position with respect to the base 1. Furthermore, the engagement between the first and second mating faces 121, 233 effectively prevents the cover 1 from sliding with respect to the base 2.

A number of contacts 20 are retained in the base 2 and extend beyond the top face 22 thereof corresponding to the through holes 100 of the cover 1. The slide plate 3 defines a number of chambers 30 therein corresponding to the through holes 100 of the cover 1. Each chamber 30 has a conductive member (not shown) fixed therein whereby when the slide plate 3 is at the engaged position, the conductive members engage with both the pins of the electronic device and the contacts 20 of the connector thereby electrically engaging the pins of the electronic device with the contacts 20 of the connector. When the slide plate 3 is moved to the released position, the conductive member is separated from the pins and the contacts 20 thereby disconnecting the pins from the contacts 20.

A driving member 31 is pivotally supported between the cover 1 and the base 2 and mechanically coupled to the slide plate 3 whereby manually rotation of the driving member 31 causes the slide plate 3 to move between the released position and the engaged position.

Although the present invention has been described with reference to the preferred embodiment, it is apparent to those skilled in the art that a variety of modifications and changes may be made without departing from the scope of the present invention which is intended to be defined by the appended claims.

What is claimed is:

1. An electrical connector comprising:

a cover having a top face adapted to support an electronic device thereon, an opposite bottom face, the cover defining a plurality of through holes between the top and bottom faces for receiving pins of the electronic device, and at least one elongate projection formed on the bottom face along one of two opposite edges of the cover, the projection having two opposite ends each defining a cutout having a first support face and a first inclined mating face;

a base having a bottom face adapted to be positioned on a circuit board and an opposite top face on which the cover is positioned to define an interior space therebetween, a number of contacts being retained in the base and projecting beyond the top face thereof corresponding to the through holes of the cover, at least a recess defined in the top face of the base for receiving the corresponding projection therein, the recess having two opposite end walls and each end wall having a second support face supporting a corresponding first support face of the cover and a second inclined mating face which matingly engages with a corresponding first inclined mating face;

a slide plate movably received in the interior space, comprising a conductive member corresponding to each through hole of the cover for electrically engaging each pin of the electronic device with the corresponding contact of the connector; and a driving member pivotally supported between the cover and the base and mechanically coupled to the slide plate whereby manual rotation of the driving member causes the slide plate to move between a released position and an engaged position.

2. The electrical connector as claimed in claim 1, wherein barbs are formed on a side wall of each recess for engaging with corresponding slots defined in the projections of the cover.

3. An electrical connector comprising:

a cover having a top face adapted to support an electronic device thereon and an opposite bottom face, the cover defining a plurality of through holes between the top and bottom faces for receiving pins of the electronic device;

a base having a bottom face adapted to be positioned on a circuit board and an opposite top face on which the cover is positioned to define an interior space therebetween, a number of contacts being retained in the base and projecting beyond the top face thereof corresponding to the through holes of the cover;

a slide plate movably received in the interior space, comprising a conductive member corresponding to each through hole of the cover for electrically engaging each pin of the electronic device with the corresponding contact of the connector; and the improvements comprising at least one elongate projection formed on the bottom face of the cover, the projection having two opposite ends each defining a cutout having a first support face and a first inclined mating face, a recess defined in the top face of the base for receiving the projection therein, the recess having two opposite end walls, each end wall having a second support face supporting the corresponding first support face of the cover and a second inclined mating face which matingly engages with the corresponding first inclined mating face for properly positioning the cover with respect to the base and for preventing the cover from sliding with respect to the base during movement of the slide plate.

4. The electrical connector as claimed in claim 3, wherein the cover has a pair of projections extending along opposite edges thereof for being received in corresponding recesses defined along edges of the top face of the base.

5. The electrical connector as claimed in claim 4, wherein barbs are formed on a side wall of each recess for engaging with corresponding slots defined in the projections of the cover.

* * * * *